United States Patent [19]

Bancroft et al.

[11] 4,106,239

[45] Aug. 15, 1978

[54] LOCKABLE WINDOW CONSTRUCTION

[75] Inventors: Joseph C. Bancroft; Peter R. Hallin, both of McComb, Miss.

[73] Assignee: Croft Metals, Inc., McComb, Miss.

[21] Appl. No.: 777,603

[22] Filed: Mar. 15, 1977

[51] Int. Cl.[2] ..... E05D 13/04

[52] U.S. Cl. ..... 49/449; 160/91; 292/67; 292/114; 292/DIG. 46

[58] Field of Search ..... 49/449, 450; 292/66, 292/67, 113, 114, DIG. 46; 160/90, 91

[56] References Cited

U.S. PATENT DOCUMENTS

| | | | |
|---|---|---|---|
| 2,826,789 | 3/1958 | Etling | 160/91 X |
| 3,070,856 | 1/1963 | Minick | 160/91 X |
| 3,795,076 | 3/1974 | Anderson | 49/449 X |
| 3,993,261 | 7/1975 | Cribben | 49/449 |
| 4,004,629 | 1/1977 | Kelly | 49/449 X |

FOREIGN PATENT DOCUMENTS

| | | | |
|---|---|---|---|
| 629,373 | 10/1961 | Canada | 292/DIG. 46 |

*Primary Examiner*—Kenneth Downey
*Attorney, Agent, or Firm*—Mason, Fenwick & Lawrence

[57] ABSTRACT

A window frame has one or more latches provided internally of a vent sill for pivotal engagement with a latch strike in the interior of a frame sill and a latch actuator extending outwardly through an opening in the inside face of the vent sill. A spring urges the latch into engagement with the strike with the latch and the actuator being movable in a linear horizontal direction so that a slot in the side of the actuator engages the edges of the opening through which the actuator extends to hold the actuator and the associated latch in a locked or non-pivotable condition. A second embodiment employs a similar pivotal and slidable latch member in a side frame of a horizontally movable vent frame which is pivoted into latching position inside an opening in a fixed vertical meeting rail and is retained in locked or non-pivotable condition by subsequent linear vertical movement of the latch to a restricted slot portion from which it cannot pivot from the locking position. Another aspect of both embodiments is the employment of L-shaped plastic extrusion glaze strips of sufficient flexibility to be usable with different panes of varying thickness and which can include cutouts for receiving and supporting the ends of muntin grid components giving the appearance of smaller panes mounted in a grid or similar shaped framework.

33 Claims, 12 Drawing Figures

35
60
10
14
34
38
36
32
40
80
81
82
74
70
72
48
87
86
59
62
58
60
17
116
114
88
64
118
120
121
104
100
102
96
112
110
108
132
106
130
107
134
111
30
22
113
150
139
90
60
24
12
26
20
18
5

2
10
34
80
72
57
258
257
48
86
116
120
16
128
102
110
132
134
130
L
107
106
12
22
4

102
100
110
112
132
108
130
138
107
30
134
106
136
150
28
152
111
139
113
90
26
22
60
20

8
10
-240-
-216-
-291-

LOCKABLE WINDOW CONSTRUCTION

This invention is in the field of building components and is specifically directed to prefrabricated window units having unique structural and functional qualities.

Conventional window units frequently employ a movable vent pane having a vent head on which a latching means is provided for cooperation with a fixed strike or the like carried by a fixed meeting rail or the lower vent sill of another movable vent frame. In either event, the latching means protrudes upwardly above the top of the meeting rail into the line of sight through the upper pane components; this type of construction consequently interferes with vision through the window members in those portions immediately adjacent the latch components and also creates an inaccessible area on the pane behind the latch which is difficult to clean.

Another problem with the previously known conventional window constructions resides in the fact that the installation and replacement of panes requires expensive labor and frequently requires access to the outside of the pane from a position external of the building in which the window unit is installed. Consequently, replacement or installation of such panes is difficult for windows on higher floors or during inclement weather.

Another shortcoming of previously known window constructions resides in the fact that the sealing means employed for sealing the pane components in the frame members is provided on the external or outside surface of the panes so that it is subjected to the detrimental effect of wind, sun, rain, snow and temperature extremes.

Yet another disadvantage of the previously known window constructions is that the latching means is in an accessible position and is easily susceptible to tampering.

Therefore, it is the primary object of this invention to provide a new and improved window means overcoming the foregoing constructions.

Obtainment of the objects of the invention is enabled by the first embodiment of the invention which consists of a window unit having a movable vent pane mounted for vertical movement in a supporting window frame of rectangular configuration. All of the frame components are formed of extruded aluminum or other suitable metal or plastic components. The movable vent sill includes an inside face plate provided with a pair of openings in each of which a latch actuator is positioned. The latch actuators are supported on the interior of the vent sill for pivotable and linear slidable movement and each is capable of pivoting inwardly and outwardly to engage a latch head on a latch strike mounted on or integral with the frame sill but extending up into a space within the confines of the movable vent sill when the vent is in its closed position. When pivoted inwardly to the locked position, the latch actuator can then be moved linearly in a horizontal direction to a point at which an edge portion engages a portion of the inside face plate of the vent sill and is consequently restrained from movement from the locked position. All of the components are positioned out of the line of sight through the panes of the window to provide for unobstructed vision and permit easy cleaning of the panes.

In a second embodiment, the movable vent pane is mounted in a movable vent frame which is horizontally movable with the strike member being positioned internally of a vertically oriented meeting rail. The latch and its manual actuator are supported for pivotal and linear movement on a side frame component of the movable vent frame positioned adjacent the meeting rail when the movable pane is closed. Here again, the latch member is capable of pivotal movement into the latching position followed by the subsequent linear movement which positions a portion of the latch member in engagement with a portion of the frame meeting rail so that the latch member is maintained in a non-pivotable latched condition.

A better understanding of the manner in which the preferred embodiments of the invention achieve the objects of the invention will be enabled when the following written description is considered in conjunction with the appended drawings in which.

Figure 2:
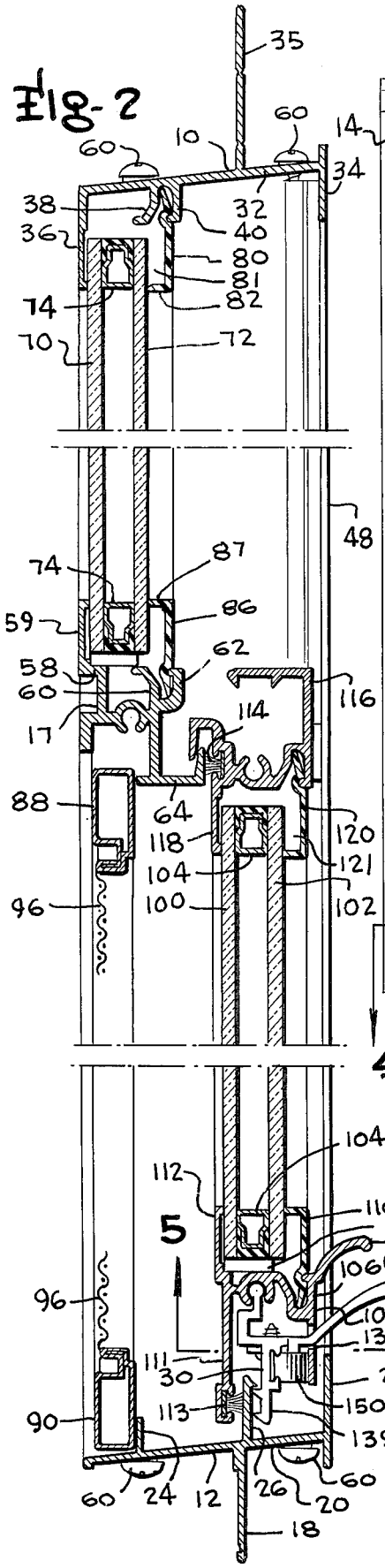
FIG. 2 is a sectional view taken along lines 2—2 of FIG. 1 illustrating the components in a latched condition.

The first embodiment of the invention illustrated in FIGS. 1 through 6 is directed to a single hung window construction including a rigid window frame formed of extruded aluminum or other suitable metal or plastic components including a frame head 10, a frame sill 12, frame jamb members 14 and 16 and a meeting rail 17 (FIG. 2) all joined together to provide a rectangular window frame capable of being mounted in the wall of a building with a minimum of difficulty.

Figure 3:
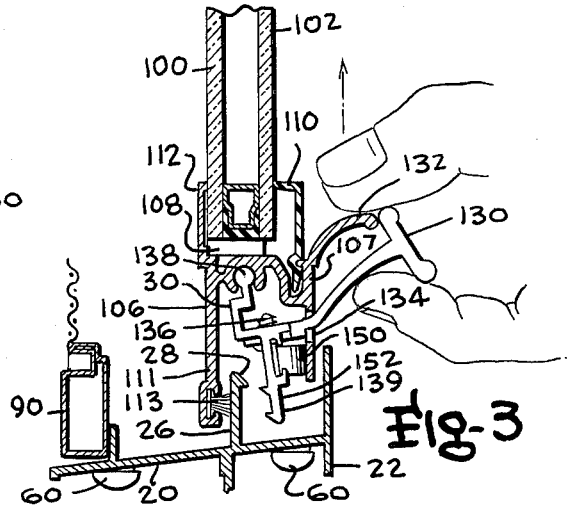
FIG. 3 is an enlarged view of a portion of FIG. 2 illustrating the parts in a different position with the components being in an unlatched condition.

Frame sill 12 includes a downwardly extending wall sill fin 18 best illustrated in FIG. 2 for enabling connection of the frame sill 12 to the lower edge of the frame opening of the building in which the window is to be mounted. Additionally, the frame sill 12 also includes a main transverse base plate component 20 extending its entire length and width with a vertically oriented sill trim flange 22 being provided along the inside edge of component 20 and a vertically oriented screen positioning flange 24 extending upwardly from a rear portion of the base plate component 20 as shown in FIGS. 2 and 3.

Additionally, a latch strike 26 extends upwardly from the surface of base plate 20 and has a latch head 28 positioned to be engaged by latching means on a pivotable latch member 30, the details of which are subsequently discussed.

Frame head 10 includes a horizontally extending main cap plate 32 to the front edge of which a vertically oriented head trim plate 34 is connected with a pane positioning and retaining flange 36 extending downwardly adjacent the rear edge of the cap plate 32. A pair of glazing bead mounting flanges 38 and 40 extend downwardly from a central portion of the main cap plate for supporting a plastic glazing strip as will be discussed hereinafter.

Figure 4:
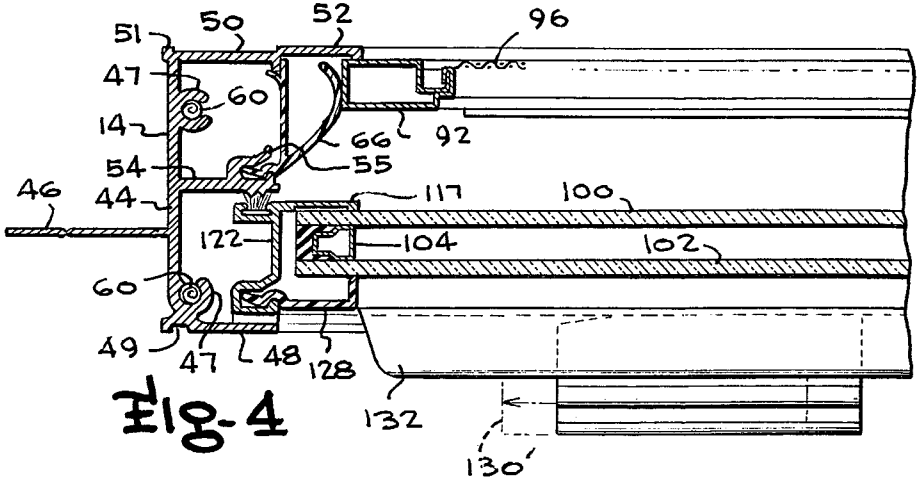
FIG. 4 is a sectional view taken along lines 4—4 of FIG. 1.

The frame jambs 14 and 16 are of identical construction as illustrated in FIG. 4 with each including a main vertical edge plate 44 from the side of which a frame mounting fin 46 extends for enabling connection to the frame of the building in which the unit is to be installed. Additionally, the frame jambs 14 and 16 also include a front side edge trim plate 48 and a rear trim plate 50 including a screen or pane positioning outer flange 52 as best shown in FIG. 4. A medial flange 54 extends inwardly from the main vertical edge plate and has a lip flange 55 adjacent its outer end to define a slot for receiving a plastic extrusion side glaze strip 57 (FIG. 1) in the upper half of its extent and a screen retainer plastic extrusion strip 66 along the lower half of its extent. Additionally, screw receiving mounting lips 47 extend inwardly from the main vertical edge plate 44 to define apertures for receiving screws 60 for connecting the frame head 10 and the frame sill 12 to the ends of the vertical frame jambs 14 and 16.

The meeting rail 17, as best illustrated in FIG. 2, includes pane positioning and retaining flanges 58 and 59 with first and second glazing bead mounting flanges 60 and 62 being provided on the inwardly facing side of the meeting rail. Additionally, an L-shaped horizontally extending seal and screen positioning flange 64 extends along the lower edge of the frame meeting rail 17.

A fixed thermal glass pane consisting of two spaced pane elements 70 and 72 separated by spacers 74 is supported on a support pad on the meeting rail 17 within the confines of the outer side edges of the frame head 10 and frame jambs 14 and 16 with pane 70 engaging the pane positioning retaining flange 36 and 59 along upper and lower edge portions thereof and with the side edge portions of the pane 70 engaging the inner surface of the flange 52 of each of the frame jambs 14 and 16. A glazing bead 80 consisting of an enlongaged extruded plastic strip is positioned between the glazing bead mounting flanges 38 and 40 on the frame head 10 and has a lower edge seal flange 82 urged to the left in FIG. 2 against the surface of pane 72 for maintaining the composite pane in position against the pane positioning and retaining flange 36. Similarly, a lower glazing strip 86 also consisting of an extruded plastic strip has a lower portion mounted between the glazing bead mounting flanges 60 and 62 and an edge seal portion 87 urged to the left against the pane 72 for maintaining the lower edge of the composite pane in engagement with the pane positioning and retaining flange 59. The side glaze strips 57 (FIG. 1) are mounted in the slots between elements 54 and 55 along both sides of pane 72 as was noted previously.

A screen supporting frame consisting of an upper frame component 88, a lower frame component 90 and side frame components 92 and 94 (FIG. 4) supports a screen member 96 extending between the frame jambs 14 and 16 and the meeting rail 17 and the frame sill 12.

Figure 1:
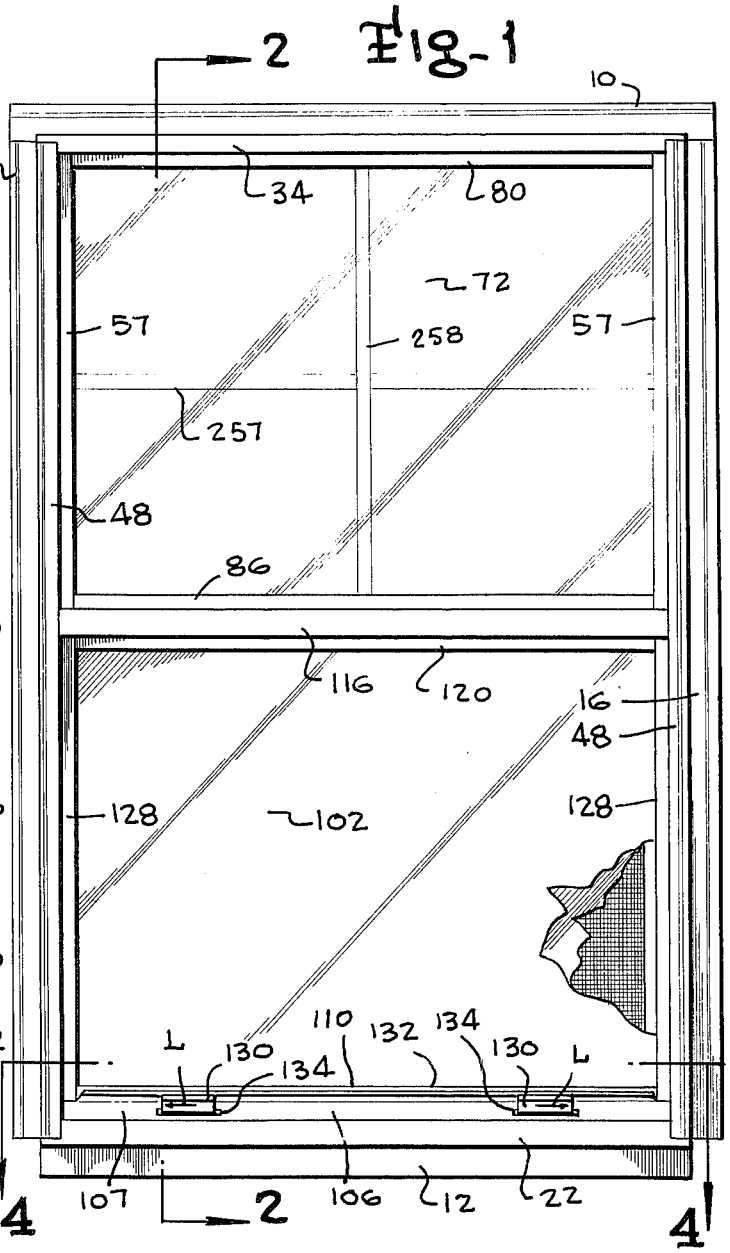
FIG. 1 is a front interior elevation view of a first embodiment of the invention in the form of a single hung window.

A movable thermal vent pane consisting of spaced pane components 100 and 102 separated by spacers 104 is mounted for movement between a lower closed position illustrated in FIG. 1 and an upper raised position in alignment with the fixed panes 70, 72. Support for the movable pane components is provided by a movable vent frame including a vent sill aluminum extrusion 106, a vent head aluminum extrusion 116 and movable side jambs 122 and 124. Vent sill 106 includes an internal face plate 107 and supports an elongated extruded glazing bead strip 110 mounted in a slot in member 106 and urged to the left in FIG. 2 against the surface of pane 102 in an obvious manner. Additionally, the vent sill 106 includes an external pane positioning or mounting flange 112 which engages the outer surface of pane 100 and an external face plate 111 supporting a brush type seating means 113 with a similar sealing means 114 being mounted on the vent head extrusion 116. Sealing means 113 and 114 respectively engage the rear of latch strike 26 and edge of seal flange 64 when the movable vent pane is in its lower closed position of FIG. 2.

The upper edges of panes 100, 102 are mounted and received in the vent head extrusion 116 by means of a rear pane mounting flange 118 (FIG. 2) and a glazing strip consisting of a plastic extrusion 120 urged to the left against the surface of pane 102. The upper end of the glazing strip 120 is positioned in a slot in the lower face of the vent head 116 in essentially the same manner that the other glazing strips 80, 82, 110 etc. are mounted in their respective supporting members. The side edges of the panes 100 and 102 are held by the movable vent jambs 122 and 124 which extend between and are connected to the vent sill 106 and the vent head 116 to form the movable vent frame. Side glazing strips 120 are mounted in the vent jambs 122 and 124 and urge the panes 100, 102 against pane mounting flanges 123 and 125 of jamb 122 and 124 respectively.

The movable vent pane 100, 102 etc. is mounted for movement between the lower or closed position illustrated in FIG. 1 and an upper raised position essentially in alignment with the upper fixed pane member 72 etc. Such movement is effected by the application of manual force to an elongated vent sill pull member 132 extending across the width of the vent sill member 106 on the front inside face thereof as best illustrated in FIG. 1.

Figure 6:
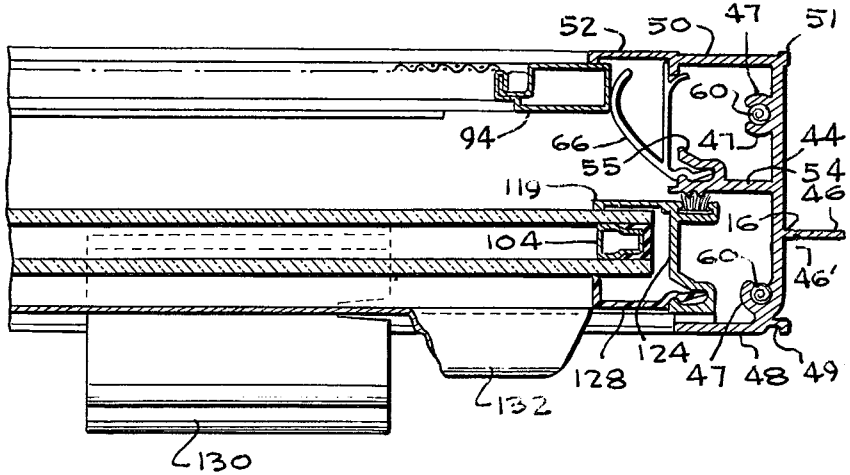
FIG. 6 is an exploded perspective view of the latch means employed in the embodiment of FIGS. 1 through 5.
Figure 6:
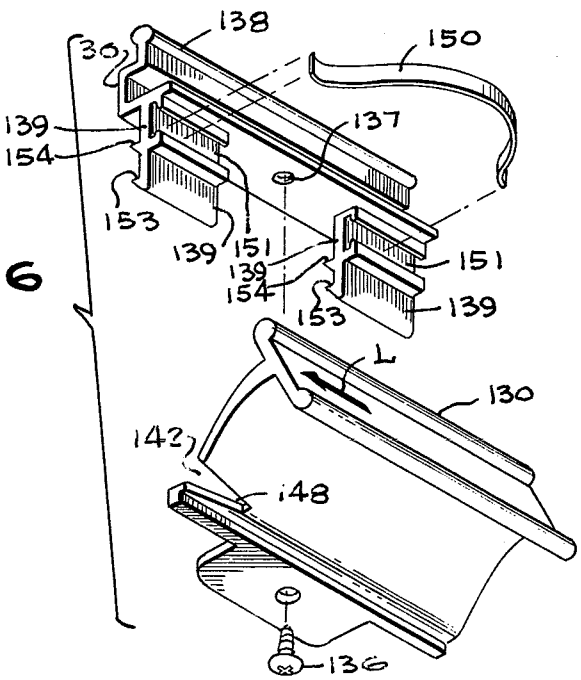

A pair of latch accommodating slots 134 (FIG. 1) are provided in the front face of the vent sill 106 with movable latch actuating members 130 extending through the slot and having an outer manually engageable portion as best illustrated in FIG. 3 with an inner portion being connected by screw means 136 to the pivotable latch member 30 which is best illustrated in FIG. 6 and includes pivot bearing portion 138 received in a circular elongated bearing slot formed in the vent sill 106 as shown in FIG. 3. The lower end of the pivotable latch member 30 includes two depending catch plates 139 positionable adjacent the latch head 28 as shown in FIG. 2 to lock the vent pane in one of two closed positions as will be discussed in detail hereinafter. It will be observed that the movable latch actuator 130 is of slightly less width than the length of slot 134 formed in the vent sill 106 so that the latch actuator can be passed through the slot 134 for connection to latch member 30 in the area between catch plates 138 by screw 136 received in opening 137 during the assembly of the components.

Figure 5:
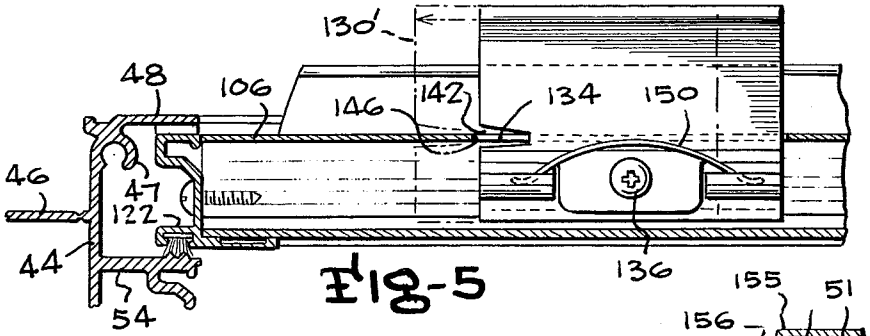
FIG. 5 is a sectional view taken along lines 5—5 of FIG. 2.

A lateral movement permitting slot 142 is provided in the movable latch actuator 130 along the edge facing the frame jambs 14 and 16 to permit the movable latch actuator to move laterally in the direction of arrows L to a locked position 130' illustrated in dotted lines in FIGS. 4 and 5. Such movement of the latch actuators to the positions 130' positions the side edge 146 (FIG. 5) of slot 134 in the narrow innermost portion 148 (see FIG. 6) of the slot 142 so that the movable latch actuator 130 is held in the locked position illustrated in FIG. 2 and is incapable of pivotal movement to the unlocked position illustrated in FIG. 3. In order for the latch actuator 130 to be pivoted to the FIG. 3 position, it must first be moved inwardly away from the 130' locked position so that the slot 142 completely clears the edge 146 of the front panel of the vent sill 106.

A bow spring 150 has its ends respectively provided in mounting slots 151 in the catch plates 138 of each of the two latch members 30 each of which has a lower catch means 153 and an upper catch means 154. Each of the catch means 153 and 154 is positionable in a locked position beneath the horizontally extending latch head 28 of latch strike 26. Bow spring 150 has a medial portion engaged with the inner surface of the front face plate 107 of the vent sill 106. Consequently, spring 150 tends to bias the pivotal latch member 30 in a clockwise direction to the locked position and opposes opening movement of means 30, 130 etc, from the position of FIG. 2 toward the position of FIG. 3.

It should be noted that the movable pane assembly 100, 102 etc. can be latched in either one of two positions consisting of a lowermost latched position in which the upper catch means 154 engahed with the latch head 28 as illustrated in FIG. 2 and a slightly higher or vent position in which the lowermost catch means 153 is engaged beneath latch head 28. In the higher or vent position, sealing means 114 will not provide a complete seal in conjunction with means 64 so that a small amount of ventilation can be achieved past seal 114 as well as past the seal 113. The degree of ventilation achieved in the upper latched position can be varied in accordance with the spacing between the upper and lower catch means 153 and 154.

Substantial other advantages are achieved by the foregoing design with one of the main advantages being that the provision of the mechanical locking means in the vent sill, rather than in the vent head as is usually the case, permits the vent head to have a flat linear top surface that is aesthetically appealing and does not have any protrusions blocking the sightline through the upper fixed pane component.

In addition, absence of a lock on the vent head also permits an easy cleaning of the upper panes since the entire inner surface of the pane 72 is accessible in a manner that will be apparent from inspection of FIG. 1. Another substantial advantage of the inventive design is that locking components 28, 130 are in a concealed and protected location rendering tampering much more difficult than is the case with conventional constructions in which the latch means is externally located. Another advantage is that the upper or fixed pane 72 etc. and the lower of movable vent pane 102 etc. are of the same size and the glass components are interchangeable so as to permit a substantial savings in the cost of the glass components.

Yet another advantage of the foregoing embodiment of the invention resides in the fact that the glazing bead elements 57, 80, 128 and 110 are all on the inside surface of the window so that the glass can be replaced from the interior of the room in which the window is located. This is obviously a substantial advantage particularly with respect to windows located on upper floors and in geograhic areas having adverse climates. Additionally, the positioning of the glazing bead components from the interior protects them from the detrimental effects of sun, wind and temperature extremes and elimates unauthorized tampering from outside.

Since the glazing bead elements are formed of plastic having a low thermal transfer capability and their use reduces exposed metal surfaces on the interior by a substantial amount to result in thermal efficiency savings over prior known window constructions. The basic L-shaped design creates a dead air space between the glass and the interior face of the bead which also adds to the insulating value.

Figure 12:
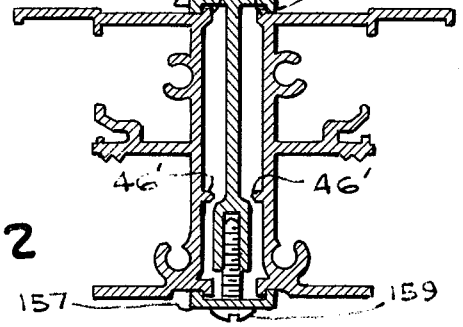
FIG. 12 is a sectional view similar to FIG. 4 illustrating the connection of adjacent window frames by mullion means.

Yet another advantage of the first embodiment of the invention resides in the fact that the frame mounting vents 46 are provided with a reduced thickness portion 46' closely adjacent the main vertical edge plate 44 from which they extend so that they can be broken away from the main edge plate to permit two of the window units to be positioned in a side-by-side arrangement as illustrated in FIG. 12. As thus positioned, a mullion of the same height as the jambs and including an external cap plate 155 having side ribs 156 engaging edge flanges 51 on the external sides of two jambs and an internal cap plate 157 similarly received in slots 49 on the interior of the jambs provide a fixed connection of the jambs upon the tightening of a plurality of screws 159 (only one of which is illustrated) positioned at discrete intervals along the mullion. Any number of adjacent windows can be associated in the foregoing manner if desired.

FIGS. 7 through 10 illustrate another embodiment of the invention which employs a horizontally movable vent pane and slidable latch means not obstructing the field of vision to the pane components in a manner similar to the first embodiment as previously discussed. Specifically, the second embodiment includes a mounting frame consisting of an extruded frame sill 160, a pair of extruded frame jambs 152 and a frame head 164 with the frame head 164 and the frame sill 160 being connected by a fixedly positioned vertical meeting rail 166 all of which are preferably formed of extruded aluminum. Frame jambs 162 includes a main vertical plate 168 (FIG. 8) on the external side of which ribs 170 are provided to define openings in which screw members for connecting the frame head 164 and the frame sill 160 are received. Additionally, a mounting fin 171 extends outwardly from the main plate 168 and is provided with a reduced thickness portion 172 to permit the mounting fin to be broken away if desired such as when the frame is being associated with another identical frame by means of a connecting mullion in a manner similar to the first embodiment. An offset groove or slot 174 is provided on the external face of the frame jamb 162 and a similar offset groove or slot 176 is provided on the internal face for the purpose of accommodating a mullion in a manner that is essentially identical to the connection illustrated in FIG. 12. The surface of the frame jamb 162 also includes an inside trim plate 178 with the external surface being defined by a face plate 180.

Similarly, the righthand frame jamb 163 is also provided with a breakaway type mounting fin 182 extending from a main vertical plate 184 which also has lip members 186 providing openings for receiving connecting screws for attaching the frame head 164 and the frame sill 160 to the upper and lower ends of the frame jamb. Slots 188 and 190 are respectively provided on the front and rear faces of the frame jamb 163 for permitting the connection of a mullion. Jamb 163 also includes an internal trim plate 192 and an external trim plate 194.

Additionally, screen positioning flanges 196 and 198 extend inwardly from the main vertical plate 184 to provide support and retention for a screen frame side element 200 which cooperates with other screen frame elements including a top frame 202, side frame 206 and a bottom horizontal frame element (not shown) to support a screen member 208.

Meeting rail 166, like members 160, 162, 163 and 164, is formed of extruded aluminum and includes an external face plate 210 having a fixed pane mounting flange 212 extending from one side for engagement with the external pane 214 of a thermal pane member having an internal pane 216 with spacers 218 provided between the pane members. The internal pane 216 is engaged on its interior surface by an elongated glazing bead consisting of an elongated extruded plastic strip 218 which is mounted in a recess defined between one side of an internal face plate 220 and a flange 222. The opposite vertical edge of the thermal pane component 216 is engaged by an identical plastic glazing strip 230 with the corresponding sides of the external pane 214 being in engagement with the external pane mounting flange 180 of the frame jamb 162.

Meeting rail 166 also includes an internal sealing and positioning flange 232 engaged with a crush or similar sealing weather stripping material means 234 carried by a horizontally movable vertically extending side frame extrusion component 236 forming part of the supporting frame for a movable thermal vent pane consisting of an internal pane 240 and an external pane 242 separated by separator means 244. The other frame components for supporting the movable thermal pane include a second side frame extrusion 238 and upper and lower horizontal frame extrusions 244 and 246 illustrated in FIG. 10. Side frame extrusion 238 includes a brush, felt or equivalent seal 247 engageable with the screen positioning flange 196 of frame jamb 163 when the movable vent pane is in a closed position and also includes a pane engaging flange 248 engaged with the outer surface of outer pane 242. An elongated vertical plastic glazing strip 250 is mounted in a slot extending vertically on the side frame 238 and engages the inner surface of the interior pane 240. Similarly, a vertical glazing strip 252 is carried by the side frame 236 and also engages the inner surface of pane 240. Upper and lower plastic glazing strips 254 and 256 are respectively carried by the upper horizontal frame component 244 and the lower horizontal frame component 246 for engagement with the inner surface of pane 240.

Figure 10:
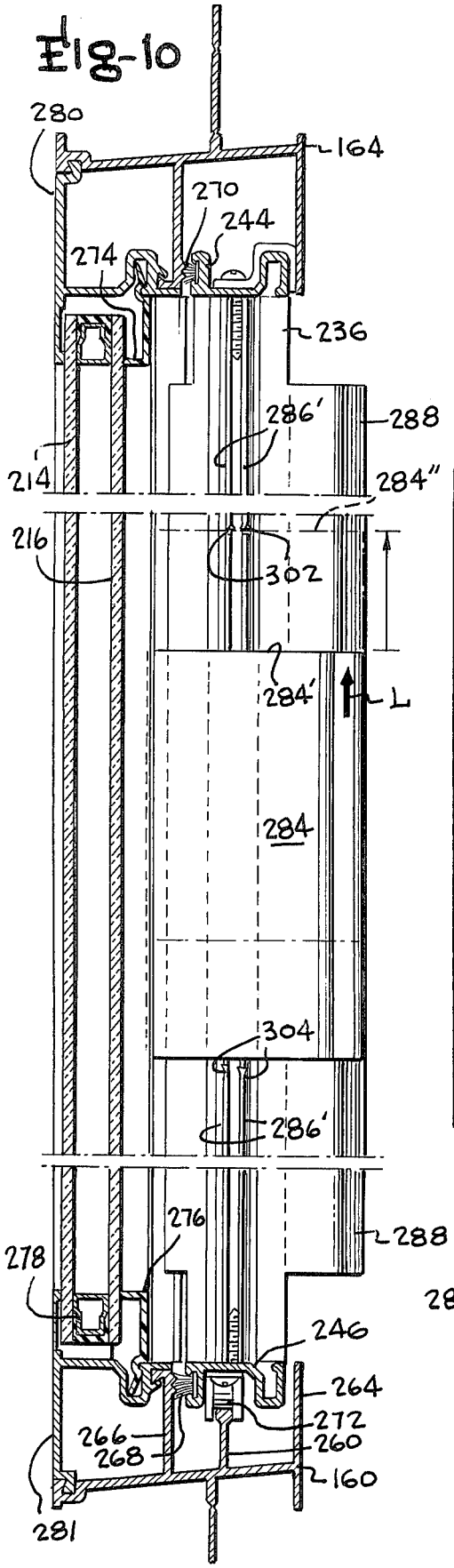
FIG. 10 is a sectional view taken along lines 10—10 of FIG. 7.

Frame sill 160 includes a rail 260 extending upwardly from a base plate 262 between an interior trim plate 264 and a medial plate 266 which is engaged by a brush type seal 268 carried on the lower horizontal frame component 246. Rail 260 provides rolling support for the movable vent frame through a plurality of rollers or wheels 272 mounted on and beneath frame component 246 as shown in FIG. 10. Consequently, the vent frame is movable horizontally by the rolling action of the rollers 272 on rail 260. It will be observed from inspection of FIG. 10 that the fixed panes 214 and 216 are respectively held in position by upper and lower extruded frame components 280 and 281 which respectively also provide support for an upper horizontal elongated plastic glaze strip 274 and a lower horizontal elongated extruded plastic glaze strip 276.

Figures 7, 8, 9:
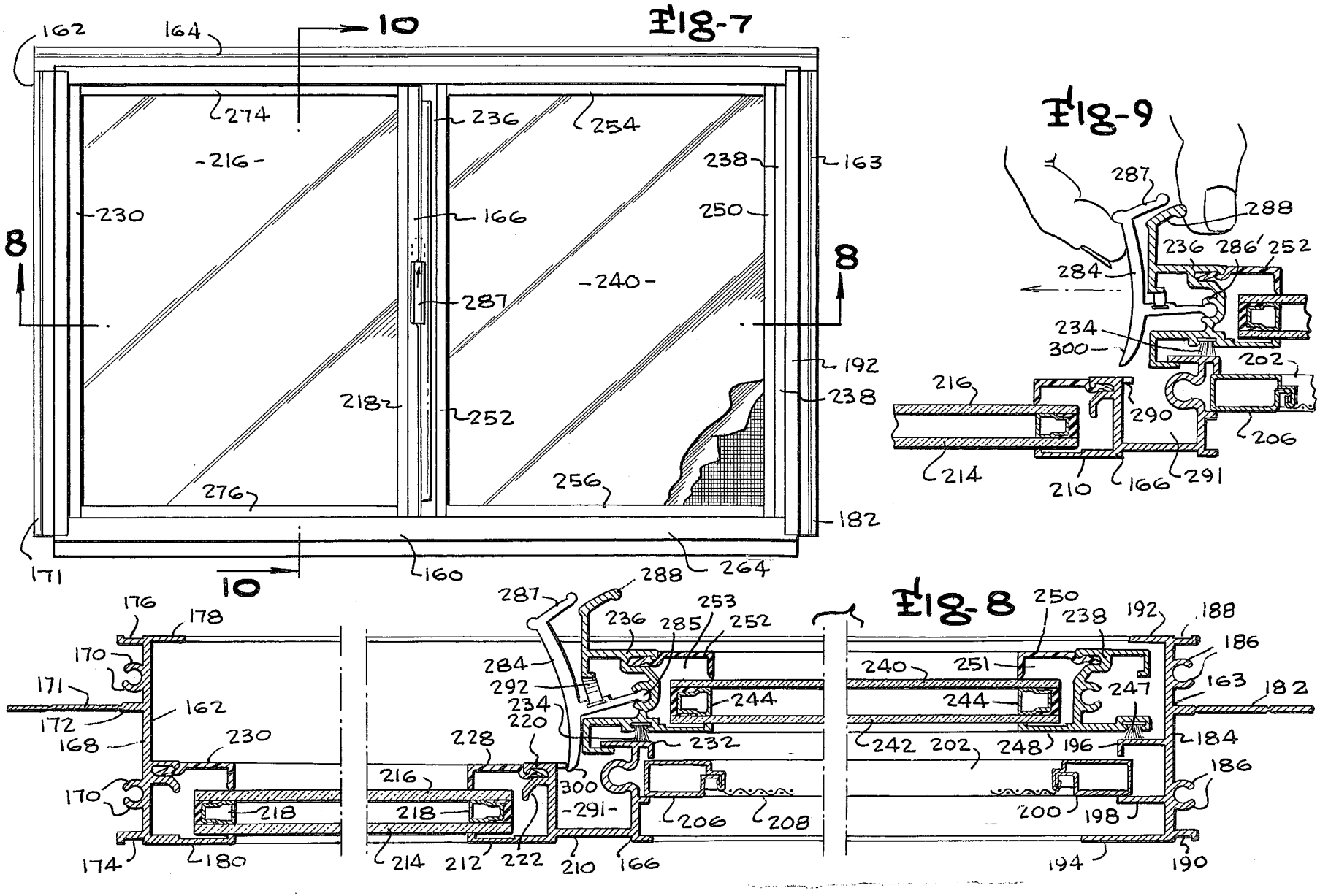
FIG. 7 is a front inside elevation view of a second embodiment of the invention in the form of a horizontal rolling window.
FIG. 8 is a sectional view taken along lines 8—8 of FIG. 7 illustrating the window in a closed and latched condition.
FIG. 9 is an enlarged view of the latching means of FIG. 8 illustrating the latch in an unlatched condition.
Figure 11:
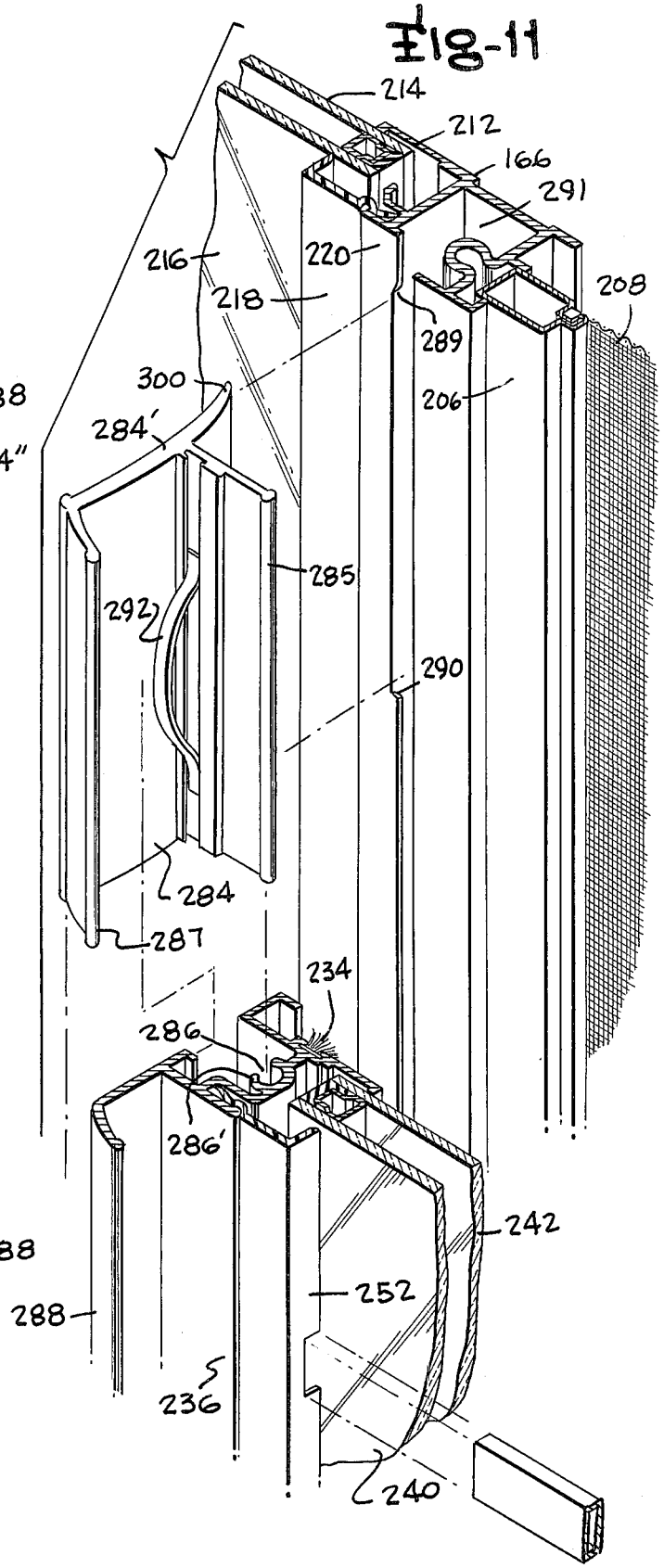
FIG. 11 is an exploded perspective view of the latching components of the embodiment of FIGS. 7 through 10.

The horizontally movable vent pane 240, 242 is movable between a closed position illustrated in FIGS. 7 and 8 and an open position in which it is in horizontal alignment with the fixed pane components 214, 216. The movable vent pane can be latched in the closed position of FIGS. 7 and 8 by means of a pivotable latch member 284 having a pivot bearing semi-cylindrical edge component 265 (FIG. 8) carried in an elongated mating vertical slot 286 formed between tabs 286' in the vertical side frame component 236 of the movable vent frame. A manually engageable latch actuator portion 287 on the pivotal latch member 284 is positioned adjacent a vent pull member 288 comprising a portion of the unitary side frame member 236 as best illustrated in FIG. 11. An inwardly extending edge slot having an upper termination 289 and a lower termination 290 is provided along the edge of internal face plate 220 as shown in FIG. 11 to permit the latch member 284 to extend inwardly into an interior chamber 291 formed in the meeting rail 166 as shown in FIG. 11.

Latch member 284 is capable of movement in a clockwise direction when the actuator portion 287 is moved from its FIG. 8 position toward the fixed vent portion 288 so as to move the inner end 300 of the latch member from within the confines of the internal space 291 to permit the movable vent pane to move to the left as shown by the arrow in FIG. 9. However, the pivotal latch member 284 can be returned to the latched or locking position illustrated in FIG. 8 in which the movable vent pane 240, 242 etc. is locked in closed position by operation of a compressible spring 292 mounted in a slot on the pivotable latch member 284. Spring 292 engages a fixed surface on the side frame 236 as shown in FIG. 8 to urge the pivotable latch member 284 into a normally closed position as shown.

Moreover, the pivotable latch member 284 can be moved upwardly in the direction of arrow L by linear sliding movement of edge component 285 in slot 286 to a position at which its upper end 284' is in the dotted line position 284" of FIG. 10 so that the innermost latching edge portion is no longer in line with the slot extending between upper and lower terminations 289, 290 and the pivotal latch member is consequently incapable of moving in a clockwise direction to clear the catch portion 300 from within the space 291. The upper position 284" is established by crimps 302 made in the two tabs 286' for limiting the lower possible extent of movement of the pivotal latch member 284.

Consequently, it will be seen that the second embodiment is similar to the first embodiment in providing a latch means that is positioned and held in a locked position by linear movement that does not interfere with the line of sight through the pane members and in which the latching components per se are in a recessed enclosed position.

Additional advantages of both embodiments are achieved by use of the plastic extrusion glazing strips 57, 110, 80, 86, 128, 218, 250, 252, 254, 256 and 274 which permit the use of glass panes having thicknesses which may vary between 3/32 inch up to and including ½ inch thick glass. Moreover, the spaces behind all of the plastic extrusion glazing strips are dead air chambers such as exemplified by dead air space 253 behind glazing strip 252 (FIG. 11) and dead air spaces 81, 121, 114, 251, 253, 277 etc. respectively behind strips 80, 120,

110, 250, 252, 276 etc. Yet another advantage provided by the L-shaped plastic extrusion glazing strips is that they can be provided with optional notches or cutouts such as at 255 in strip 252 (FIG. 11) to receive the end of a decorative interior muntin grid strip 257 to give a colonial or other decorative effect such as also exemplified by muntin strips 257 and 258 in FIG. 1.

Numerous modifications of both embodiments of the invention will undoubtedly occur to those of skill in the art; for example, the extruded components could be formed of materials other than aluminum or metal. Similarly, the lips 286' which define the vertical cylindrical bearing slot 286 receiving semicylindrical edge component 285 of latch member 284 can be provided with a cut-out notch intermediate their ends for permitting latch member 284 to be inserted or removed at the notch for assembly or repair purposes. A similar notch can also be provided in the elements forming the cylindrical bearing slot receiving pivot bearing portion 138 of the first embodiment for the same purpose. Therefore, it should be understood that the spirit and scope of the invention is to be limited solely by the appended claims.

We claim:

1. A lockable window comprising a supporting frame, a movable vent pane frame mounted for movement on said supporting frame between an open position and a closed position, movable latch means for locking said movable vent pane frame in said closed position, a movable hand operated latch actuator connected to said movable latch means for unitary movement therewith, latch support means on said movable vent pane frame supporting said movable latch means and latch actuator for both pivotable and linear movement on said movable vent pane frame so that the movable latch is pivotable to a locking position in which said latch means engages retaining means on said supporting frame to lock said movable vent pane frame in its closed position and is linearly movable into a holding position while in said locking position in which a portion of said latch actuator engages a portion of said movable vent pane frame to prevent pivotable movement of said latch actuator from said locking position.

2. The invention of claim 1 wherein said supporting frame includes a frame sill and said retaining means comprises a latch strike positioned internally of said frame sill.

3. The invention of claim 1 wherein said movable vent pane frame includes a horizontally extending vent sill, said vent sill comprises an extrusion including an external face plate, an internal face plate, an opening provided in said internal face plate, said support means being positioned in a hollow space between said internal face plate and said external face plate wherein said latch actuator extends through said opening in said internal front face plate and is connected to said latch means in said hollow space.

4. The invention of claim 1 wherein said latch supporting means includes a bearing means supporting said latch and latch actuator for pivotal movement about a pivot axis and sliding movement parallel to said pivot axis.

5. The invention of claim 4 wherein said movable vent pane frame includes a horizontally extending vent sill, said vent sill comprises an extrusion including an external face plate, an internal face plate, an opening provided in said internal face plate, said support means being positioned in a hollow space between said internal face plate and said external face plate wherein said latch actuator extends through said opening in said internal face plate and is connected to said latch means in said hollow space.

6. The invention of claim 4 wherein said supporting frame includes a frame sill and said retaining means comprises a latch strike positioned internally of said frame sill.

7. The invention of claim 1 wherein said supporting frame includes a sill including a horizontally extending base plate having an inside edge and an outside edge, a sill trim flange extending along the length of said inside edge of said base plate and oriented in a plane having a substantial vertical component, said retaining means including a latch strike consisting of an upwardly extending strike plate extending upwardly from said base plate at a location spaced outwardly from said sill trim flange to define an open-topped space between said strike plate, said sill trim flange and said base plate, latch head means provided on an upper portion of said strike plate extending horizontally into said open-topped space toward said sill trim flange and having a downwardly facing surface facing said base plate, said vent frame including a horizontally extending vent sill positioned adjacent said frame sill when said vent frame is in said closed position, said vent sill including an internal face plate defining its inner extent, said latch means including a pivot surface, said support means including means supporting said latch means at said pivot surface for pivotal movement about a horizontal pivot axis, said latch means including downwardly extending catch plate means, catch means on a lower portion of said catch plate means positioned in said open-topped space when said movable vent pane frame is in its closed position so that pivotable movement of said catch plate about said horizontal pivot axis towards said strike plate positions said catch means beneath said downwardly facing surface of said latch head in said locking position to prevent movement of said vent frame toward its open position, an elongated opening in said internal face plate adjacent said latch means, said latch actuator extending through said elongated opening and having an external manually engagable portion spaced from said face plate, a locking surface provided in one side of said latch actuator positioned adjacent to and in alignment with an edge of said elongated opening when said latch actuator is positioned so that said catch means is positioned beneath said latch head so that subsequent linear movement of said latch actuator positions said locking surface behind a portion of said internal face plate extending from an edge of said opening to prevent pivotal movement of said catch means from beneath said latch head.

8. The invention of claim 7 wherein said catch plate means comprises first and second vertical catch plate members.

9. The invention of claim 7 additionally including second latch means identical to said first latch means, second latch actuator means connected to said second latch means, a second elongated opening in said internal face plate through which said second latch actuator extends and a locking surface on said second latch actuator engagable with said trim plate in the same manner and purpose as said first locking surface.

10. The invention of claim 9 wherein said first and second latch actuators are horizontally aligned adjacent respective opposite end portions of said internal face plate.

11. The invention of claim 7 wherein said means supporting said latch means for pivotal and linear movement comprises an elongated horizontal cylindrical surface bearing groove provided internally of said vent sill.

12. The invention of claim 7 wherein said vent sill additionally includes an external face plate positioned outwardly of said strike plate when said vent frame is in its closed position and brush type sealing means mounted on said external face plate engaging the side of said strike plate opposite said open-topped space.

13. The invention of claim 12 additionally including second latch means identical to said first latch means, second latch actuator means connected to said second latch means, a second elongated opening in said internal face plate through which said second latch actuator extends and a locking surface on said second latch actuator engagable with said trim plate in the same manner and purpose as said first locking surface.

14. The invention of claim 13 wherein said first and second latch actuators are horizontally aligned adjacent respective opposite end portions of said internal face plate.

15. The invention of claim 14 wherein said means supporting said latch means for pivotal and linear movement comprises an elongated horizontal cylindrical surface bearing groove provided internally of said vent sill.

16. The invention of claim 12 additionally including first and second vent sill pull members respectively extending from said internal face plate above said internal face plate above said first and second latch actuators spaced close to the latch actuators to permit a latch actuator and its associated vent sill pull to be engaged between the thumb and fingers of a user to pivot the latch actuators and associated latch members to an unlocked position.

17. The invention of claim 7 additionally including spring means positioned between said internal face plate and said latch means for constantly urging said latch means into its locking position.

18. The invention of claim 1 wherein said supporting frame includes a horizontally extending frame meeting rail, a fixed pane mounted above said meeting rail, the vent pane frame includes a horizontally extending vent head positioned in horizontal alignment with said frame meeting rail when said vent pane frame is in its closed position and wherein no part of the movable vent frame extends above the top of the meeting rail when the vent pane frame is in its closed position.

19. The invention of claim 18 wherein said movable vent pane frame is movable vertically and includes a horizontally extending vent sill, said vent sill comprising an extrusion including an external face plate, an internal face plate, an opening provided in said internal face plate, said support means comprising an elongated slot having a cylindrical bearing surface positioned in a hollow space between said internal face plate and said external face plate wherein said latch actuator extends through said opening in said internal face plate and is connected to said latch means in said hollow space.

20. The invention of claim 19 additionally including bow spring means positioned between said latch means and said internal face plate for urging said latch means toward its locking position.

21. The invention of claim 1 wherein said movable vent frame is supported for horizontal movement between its opened and closed positions.

22. The invention of claim 21 wherein said movable latch means is mounted on a vertically extending side frame component of said vent frame.

23. The invention of claim 22 wherein said supporting frame includes a frame head and a frame sill, said frame sill including a horizontally extending track supporting said movable vent frame for horizontal movement and a vertically extending meeting rail extending between said frame sill and said frame head, said meeting rail including an internal face plate and a hollow chamber behind said face plate, a linear slot extending inwardly from one edge of said internal face plate having a vertical extent slightly greater than the vertical extent of said latch means and of sufficient width to permit an outer catch end of said latch to enter said hollow chamber to place said latch in its locking position.

24. The invention of claim 23 wherein said latch means includes a vertically oriented pivot bearing having a cylindrical outer surface received within a cylindrical bearing surface in said side frame for pivotal movement about the axis of said cylindrical bearing surface and linear movement along the axis of said cylindrical bearing surface so that said outer catch end of said latch means can be pivoted into the hollow chamber of said meeting rail through said edge slot and can be subsequently moved linearly from alignment with said edge slot so that edge portions of said internal face plate adjacent said linear slot prevent movement of said outer catch end of said latch means from within the chamber on the interior of said meeting rail to hold said latch in its locking position.

25. The invention of claim 24 additionally including means for urging said latch means toward its locking position.

26. The invention of claim 25 additionally including a vent pull means on said side frame component adjacent said latch actuator to permit the vent sill and latch actuator to be grasped between the thumb and fingers of the hand of a user to pivot said latch means to its unlocked position.

27. The invention of claim 21 wherein said latch means and latch means actuator is a one-piece extrusion, said support means supports said latch actuator and said latch means for pivotal movement about a vertical axis.

28. The invention of claim 27 wherein said movable vent frame is supported for horizontal movement between its opened and closed positions.

29. The invention of claim 28 wherein said supporting frame includes a frame head and a frame sill, said frame sill including a horizontally extending track supporting said movable vent frame for horizontal movement and a vertically extending meeting rail extending between said frame sill and said frame head, said meeting rail including an internal face plate and a hollow chamber behind said face plate, a linear slot extending inwardly from one edge of said internal face plate having a vertical extent slightly greater than the vertical extent of said latch means and of sufficient width to permit an outer catch end of said latch to enter said hollow chamber to place said latch in its locked position.

30. The invention of claim 1 wherein said movable vent pane frame includes a plurality of rear pane mounting flanges against which the outer surface of a pane frame is engaged and a plurality of slots in said vent pane frame each receiving an elongated removable glaze strip extrusion bearing against the inner face of said pane whereby the pane can be removed from the interior of a building in which the supporting frame is mounted.

31. The invention of claim 30 wherein said supporting frame includes a frame sill and said retaining means comprises a latch strike positioned internally of said frame sill, said movable vent pane frame including a horizontally extending vent sill, said vent sill comprising an aluminum extrusion including an external face plate, and internal face plate, an opening provided in said internal face plate, said support means being positioned in a hollow space between said internal face plate and said external face plate wherein said latch actuator extends through said opening in said internal frone face plate and is connected to said latch means in said hollow space.

32. The invention of claim 30 wherein said elongated removable glaze strip extrusions are of L-shaped cross-section and define a dead air space adjacent the edges of the panes with which they are in contact.

33. The invention of claim 32 additionally including muntin strip mounting notches cut in said glaze strip extrusions adjacent the pane with which said extrusions are in contact and muntin grid strips positioned and retained in said muntin strip mounting notches.

* * * * *